United States Patent [19]

Forno

[11] 4,067,089

[45] Jan. 10, 1978

[54] INTERCONNECTIBLE PREFABRICATION ELEMENTS

[76] Inventor: Lorenzo Forno, Largo Colle Caprile 17-5, 16030 Uscio, Genoa, Italy

[21] Appl. No.: 667,357

[22] Filed: Mar. 16, 1976

[51] Int. Cl.[2] ..... A44B 19/06; E04C 1/04

[52] U.S. Cl. ..... 24/205.13 R; 52/574; 52/229; 52/652; 404/41

[58] Field of Search ..... 24/205 G, 205.13 R; 52/474, 574, 229; 403/339, 381, 331; 14/27; 404/41

[56] References Cited

U.S. PATENT DOCUMENTS

| | | | |
|---|---|---|---|
| 2,331,618 | 10/1943 | Morin | 24/205.13 R |
| 2,495,033 | 1/1950 | Sullivan | 24/205.13 R |
| 3,132,398 | 5/1964 | Schwendt | 24/205.13 R |

FOREIGN PATENT DOCUMENTS

| | | | |
|---|---|---|---|
| 836,781 | 4/1952 | Germany | 24/205.13 R |
| 803,434 | 4/1951 | United Kingdom | 24/205.13 R |

*Primary Examiner*—Bernard A. Gelak
*Attorney, Agent, or Firm*—Mason, Fenwick & Lawrence

[57] ABSTRACT

An element for use with others of a like kind in the prefabrication of structures such as sliding clasp fasteners, comprising a hexahedral body of rectangular cross-section, the two faces of one of the two pairs of parallel faces defining said cross-section being of unequal length with that of relatively greater length having therein a longitudinal parallel-sided groove penetrating the remaining two faces of the body, and a parallel-sided tenon similar in width to said groove projecting from at least one of said remaining two faces.

9 Claims, 11 Drawing Figures

(a)

(b)

(c)

INTERCONNECTIBLE PREFABRICATION ELEMENTS

This invention relates to interconnectible prefabrication elements.

According to the present invention there is provided an interconnectible prefabrication element comprising a body having one face with at least one groove thereon, two opposing faces having respective tongue elements projecting from said opposing faces, wherein said opposing faces of the body are tapered towards each other to form a dovetail-shaped body and the tongue elements project from the narrow end of the body and the groove intersects the opposing faces of the body at the broad end of the body.

Embodiments of the present invention will now be described by way of example with reference to the accompanying drawings in which:

FIGS. 1 (*a*), (*b*), (*c*) and (*d*) are respectively a front elevation, and end elevation, a plan view and a perspective view of a prefabrication element according to the present invention;

Figure 6:
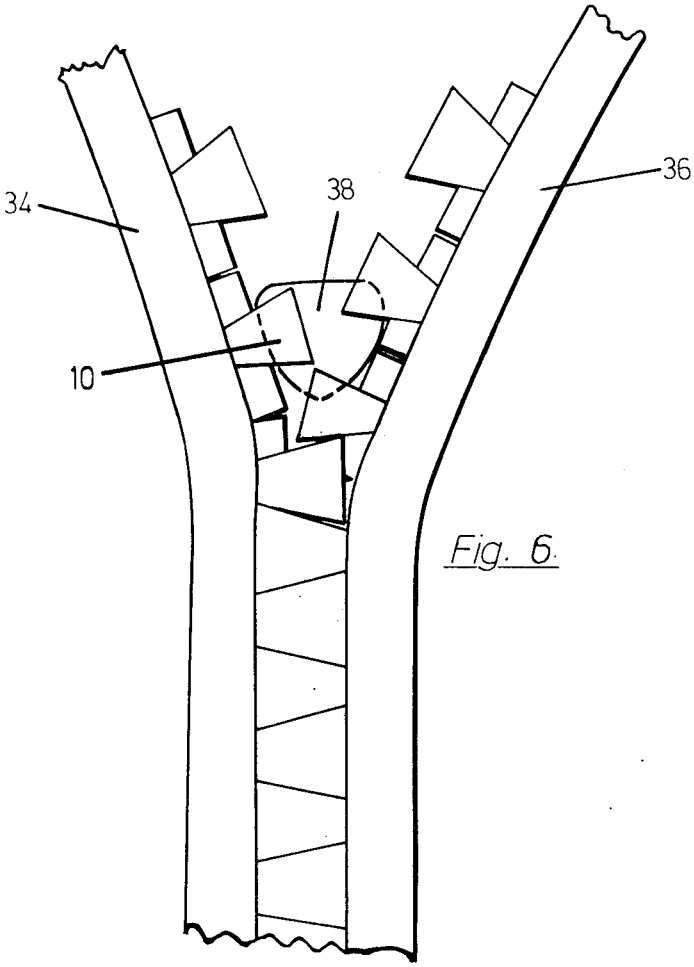
Figure 5:
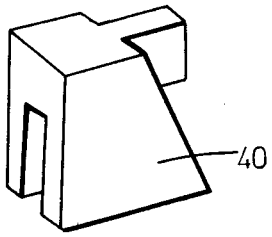
Figure 5:
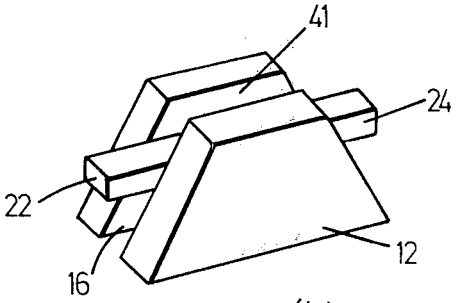
Figure 5:
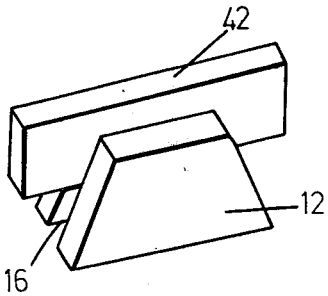

FIGS. 5 (*a*), (*b*) and (*c*) are perspective view of various modified shapes of elements, the shapes of which facilitate the interconnection of elements; and FIG. 6 shows a number of prefabrication elements attached to two stringer tapes which elements co-operate with a sliding clasp to form a sliding clasp fastener.

Figure 1:
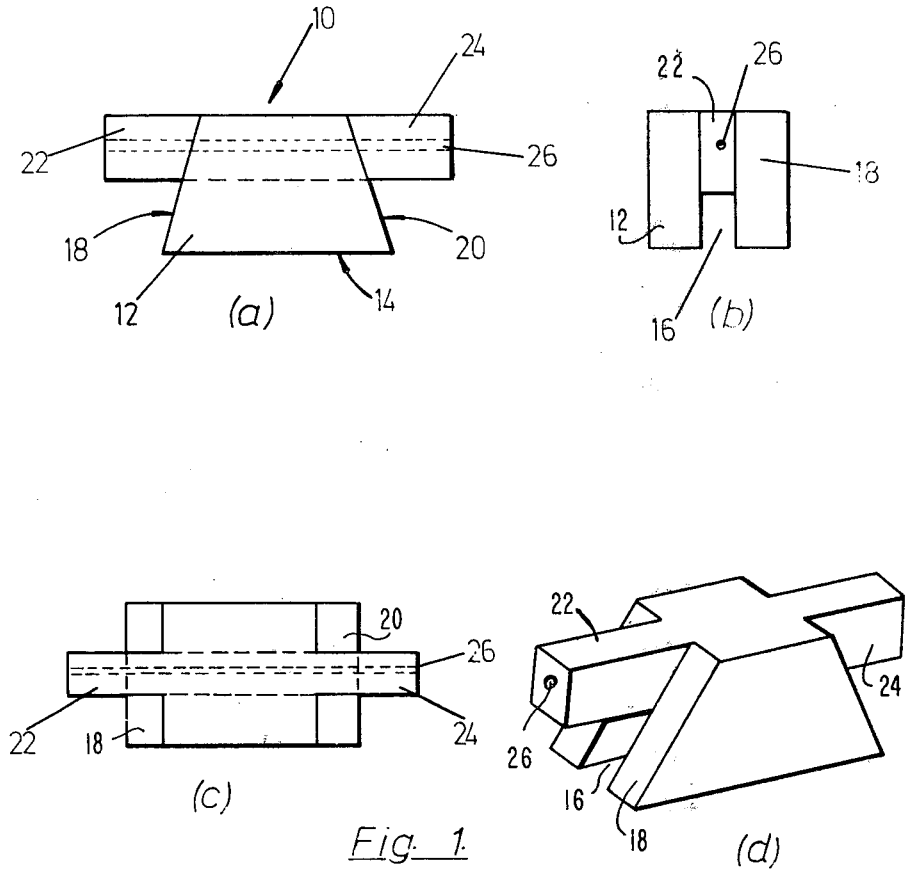

In FIG. 1, a prefabrication element 10 comprises a body 12 having one face 14 with a groove 16 thereon. The groove 16 is of rectangular cross section and runs parallel to the side edges of the face 14, the body 12 has two opposing faces 18 and 20 which have tongue elements 22 and 24 of rectangular cross section projecting from each face 18 and 20 respectively. The faces 18 and 20 are inclined towards each other so that the body 12 is dovetail shaped. The tongue elements 22, 24 and the portion of the body 12 aligned with the tongue elements 22, 24 have a bore 26 passing therethrough, which bore 26 is used to accommodate fastening means for fastening a plurality of the prefabrication elements together.

Figure 2:
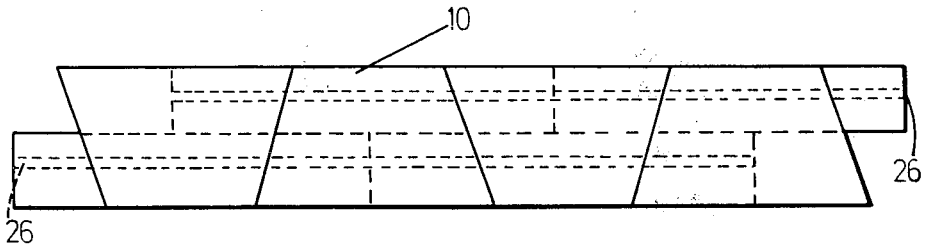
FIG. 2 shows a number of interconnected prefabrication elements of the type shown in FIG. 1.

In FIG. 2, the elements 10 are interconnected to form a row of elements as shown and fastening elements (not shown) such as wires, tubes or bolts are located in the bores 26 to prevent longitudinal movement of the elements 10. The dovetail shape of the elements 10 and the tongue elements 22, 24 prevent lateral displacement of the elements. The structure formed thereby is rigid in the plane of the surface 14.

One application of the invention would be to construct a sea wall or barrier by interconnecting a plurality of the elements 10, for example across the entrance of a harbour during stormy weather to protect ships within the harbour. The elements 10 would be constructed from a buoyant material or alternatively would be of hollow construction to enable the elements to float. The elements 10 would be constructed on land and then towed to the position on the water where they would be connected to similar elements 10. Such a barrier could be assembled rapidly so that a sea wall could be constructed at the first sign of adverse weather conditions.

Figure 3:
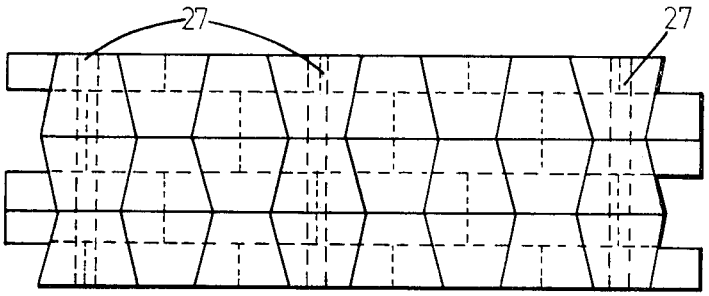
FIG. 3 shows a number of rows of interconnected prefabrication elements.

Due to the rigidity of a row of interconnected elements 10 in the plane parallel to the surface 14, the elements could be suitably interconnected to form floating piers, or walkways. Floating roads could also be constructed using larger elements 10 or by combining a number of rows of elements 10 together as shown in FIG. 3 in which fastening means (not shown) are accommodated in laterally extending bores 27 in the elements 10.

A row of elements 10 could also be used to section off an area of water for use by swimmers only, thereby preventing the possibility of swimmers being injured by pleasure craft in the same vicinity.

A further application of the invention would be to combine a number of the elements 10 to form building structures, each element 10 containing an accommodation apartment. A plurality of elements combined as shown in FIG. 3, could be used to form a roof structure.

A still further application of the invention would be to provide a row of said interconnnected elements 10 along the edge of roads to form a crash barrier.

Figure 4:
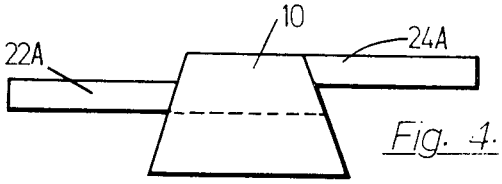
FIG. 4 shows a modified form of the element.

In FIG. 4, the elements 10 could have stepped tongue elements 22A and 24A which would overlap corresponding tongue elements on adjacent interconnected elements 10.

In FIG. 5 (*a*), half elements 40 may be used to finish a row of interconnected elements 10 and thereby form a complete rectangular structure.

In FIG. 5 (*b*), a groove 41 is cut on the narrow side of the body 12 having the same width as the tongue elements 22, 24 and a complementary part of the tongue elements 22, 24 is also removed, accordingly, and in FIG. 5 (*c*) the width of the tongue elements are extended to form a continuous tongue element 42 projecting beyond the body 12. Two rows of elements 10 of the type shown in FIGS. 5(*b*) and (*c*) respectively, may be joined together laterally by inserting the projectiong continuous tongue elements 42 of one row of elements 10 into the grooves 41 of the other row of elements 10.

By using the basic element 10 in FIG. 1 in conjunction with the modified elements in FIGS. 4 and 5, a large combination of structures of various shapes may be constructed. One application of this facility would be to allow the construction of large floating platforms. A further application of this facility would be to provide a set of building blocks for children, in which the elements 10 would form the blocks.

In FIG. 6 each element 10 is connected to one of two stringer tapes 34, 36. A sliding clasp, the heart-shaped divider 38 of which is shown, co-operates with the two stringer tapes 34 and 36 and their associated elements 10 to form a sliding clasp fastener, the fastened element being held in position by the tongue elements 22, 24 engaging the grooves 16 and by the dovetailing of the elements 10. In addition each element 10 may be decorated with a brilliant for decoration. A lock may also be incorporated in the clasp to prevent the clasp from slipping from a desired position. Such a lock may be in the form of a pin pivotally mounted at one end of the clasp, the other end being movable into gaps formed between the elements 10 as they begin to separate.

Although in the embodiments shown in FIGS. 1,2,3, and 6, the width of the tongue elements and the depth of the grooves are equal to one half of the width of the body, the tongue elements and grooves may have smaller widths which would still maintain a strong interlocking relationship between interconnected elements.

In a modification of the invention, the faces 18, 20 and their associated tongue elements 22, 24 are inclined suitably with respect to each other so that the elements when interconnected would follow a curved line.

In a further modification of the invention the groove 16 may be split into two discontinuous grooves and the tongue elements shortened correspondingly for engagement with said grooves.

What is claimed is:

1. An element for use with others of a like kind in the prefabrication of structures, comprising a hexahedral body of rectangular cross-section, the two faces of one of the two pairs of parallel faces defining said cross-section being of unequal length with that of relatively greater length having therein a longitudinal parallel-sided groove penetrating the remaining two faces of the body, and a parallel-sided tongue similar in width to said groove projecting from at least one of said remaining two faces.

2. An element for use with others of a like kind in the prefabrication of structures, comprising a hexahedral body of rectangular cross-section, the two faces of one of the two pairs of parallel faces defining said cross-section being of unequal length with that of relatively greater length having therein a longitudinal central parallel-sided groove penetrating the remaining two faces of the body, and two parallel-sided tongues similar in width to said groove and projecting one from each of said remaining two faces centrally relative to the two faces of the other of said two pairs of parallel faces.

3. An element as set forth in claim 2, having a bore extending longitudinally through said tongues and said body, which bore may be used to receive a tensile element for locking the element with a number of like elements when interconnected together.

4. An element as set forth in claim 3, wherein said tensile element is a bolt.

5. An element as set forth in claim 3, wherein the tensile element is a steel wire.

6. An element as set forth in claim 2, having a bore extending laterally through the body between the two parallel faces of unequal length which bore may be used to receive a tensile element for locking the element with a number of adjacent like elements.

7. An element as set forth in claim 2, wherein the longitudinal axes of the tenons are displaced laterally of each other.

8. A sliding clasp fastener which includes a plurality of elements each comprising a hexahedral body of rectangular cross-section, the two faces of one of the two pairs of parallel faces defining said cross-section being of unequal length with that of relatively greater length having therein a longitudinal central parallel-sided groove penetrating the remaining two faces of the body, and two collinear parallel-sided tongues similar in width to said groove and projecting one from each of said remaining two faces in surface continuity with the smaller of said two faces of unequal length and centrally relative to the two faces of the other of said two pairs of parallel faces a pair of stringer tapes, means attaching to each of said stringer tapes a longitudinal series of said elements similarly oriented and backed on to the tape at the tongue-extended faces thereof, and a sliding clasp for joining together and separating alternate elements on each stringer tape.

9. A sliding clasp fastener as set forth in claim 8, wherein the sliding clasp includes a locking element for locking the clasp in a non-sliding position relative to the stringer tapes and their associated elements.

* * * * *